US009754537B2

(12) United States Patent
Lee et al.

(10) Patent No.: US 9,754,537 B2
(45) Date of Patent: Sep. 5, 2017

(54) ORGANIC LIGHT EMITTING DISPLAY DEVICE AND DRIVING METHOD THEREOF

(71) Applicants: Dong-Eup Lee, Yongin (KR); Hyoung-Sik Moon, Yongin (KR)

(72) Inventors: Dong-Eup Lee, Yongin (KR); Hyoung-Sik Moon, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 105 days.

(21) Appl. No.: 13/935,700

(22) Filed: Jul. 5, 2013

(65) Prior Publication Data

US 2014/0146030 A1 May 29, 2014

(30) Foreign Application Priority Data

Nov. 26, 2012 (KR) ..... 10-2012-0134591

(51) Int. Cl.
*G09G 3/3291* (2016.01)
*G09G 3/3208* (2016.01)
(Continued)

(52) U.S. Cl.
CPC ..... *G09G 3/3291* (2013.01); *G09G 3/3208* (2013.01); *G09G 3/3233* (2013.01);
(Continued)

(58) Field of Classification Search
CPC ... G09G 2300/0819; G09G 2300/0842; G09G 2300/0852; G09G 2300/0866; G09G 2310/0251; G09G 2310/0272; G09G 2310/0297; G09G 3/3208; G09G 3/3233; G09G 3/3283; G09G 3/3291
(Continued)

(56) References Cited

U.S. PATENT DOCUMENTS

2003/0085885 A1* 5/2003 Nakayoshi et al. ..... 345/205
2006/0001618 A1* 1/2006 Shin ..... 345/76
(Continued)

FOREIGN PATENT DOCUMENTS

EP 1-347-436 A2 9/2003
KR 10-2006-0018764 A 3/2006
KR 10-2008-0067489 A 7/2008

OTHER PUBLICATIONS

Office Action mailed May 13, 2014 in corresponding European Patent Application No. 13181955.9.
Taiwanese Office Action dated Dec. 20, 2016.

*Primary Examiner* — Tony Davis
(74) *Attorney, Agent, or Firm* — Lee & Morse P.C.

(57) ABSTRACT

An organic light emitting display device includes a scan driver progressively supplying a scan signal to scan lines, a data driver supplying data signals to output lines of the data driver during a period in which the scan signal is supplied, and demultiplexers respectively coupled to the output lines of the data driver, and supplying the data signals to data lines, each demultiplexer including first switches, each first switch being coupled between an output line of the data driver and a data line among a first set of data lines, and a second switch coupled between a first initialization power source and a data line among a second set of data lines, wherein the first set of data lines includes the second set of data lines and at least one other data line.

19 Claims, 5 Drawing Sheets

(51) Int. Cl.
*G09G 3/3233* (2016.01)
*G09G 3/3283* (2016.01)

(52) U.S. Cl.
CPC ... *G09G 3/3283* (2013.01); *G09G 2300/0819* (2013.01); *G09G 2300/0842* (2013.01); *G09G 2300/0852* (2013.01); *G09G 2300/0866* (2013.01); *G09G 2310/0251* (2013.01); *G09G 2310/0272* (2013.01); *G09G 2310/0297* (2013.01)

(58) Field of Classification Search
USPC ..... 345/76, 205
See application file for complete search history.

(56) References Cited

U.S. PATENT DOCUMENTS

| | | | | |
|---|---|---|---|---|
| 2006/0071884 | A1* | 4/2006 | Kim | 345/76 |
| 2006/0107146 | A1* | 5/2006 | Kim et al. | 714/727 |
| 2006/0151745 | A1 | 7/2006 | Kim et al. | |
| 2007/0057877 | A1* | 3/2007 | Choi et al. | 345/76 |
| 2007/0075937 | A1* | 4/2007 | Kim | 345/76 |
| 2009/0207104 | A1 | 8/2009 | Lee | |

* cited by examiner

ORGANIC LIGHT EMITTING DISPLAY DEVICE AND DRIVING METHOD THEREOF

CROSS-REFERENCE TO RELATED APPLICATION

This application claims priority to and the benefit of Korean Patent Application No. 10-2012-0134591, filed on Nov. 26, 2012, in the Korean Intellectual Property Office, and entitled: "Organic Light Emitting Display Device and Driving Method Thereof," the entire content of which is incorporated herein by reference.

BACKGROUND

1. Field

An aspect of the present invention relates to an organic light emitting display device and a driving method thereof, and more particularly, to an organic light emitting display device and a driving method thereof, which can improve image quality.

2. Description of the Related Art

Recently, there have been developed various types of flat panel display devices capable of reducing the disadvantageous weight and volume typical of cathode ray tubes. The flat panel display devices include a liquid crystal display, a field emission display, a plasma display panel, an organic light emitting display device, and the like.

Among these flat panel display devices, the organic light emitting display device displays images using organic light emitting diodes that emit light through recombination of electrons and holes. The organic light emitting display device has a fast response speed and is driven with low power consumption. In a general organic light emitting display device, current corresponding to a data signal is supplied to an organic light emitting diode, using a transistor formed in each pixel, so that the organic light emitting diode emits light.

SUMMARY

Embodiments are directed to an organic light emitting display device, including a scan driver progressively supplying a scan signal to scan lines, a data driver supplying data signals to output lines of the data driver during a period in which the scan signal is supplied, and demultiplexers respectively coupled to the output lines of the data driver, and supplying the data signals to data lines, each demultiplexer including: first switches, each first switch being coupled between an output line of the data driver and a data line among a first set of data lines, and a second switch coupled between a first initialization power source and a data line among a second set of data lines, wherein the first set of data lines includes the second set of data lines and at least one other data line.

The first initialization power source may be set to a voltage lower than that of the data signals.

The at least one other data line may include a first data line, the first data line being a data line to which a data signal is initially supplied among the first set of data lines.

The first switches may be progressively turned on, corresponding to control signals.

A second data signal may be supplied to a first switch of the second set of data lines, the second data signal having a second width, and a control signal supplied to a first switch coupled to the first data line may have a first width identical to or wider than the second width.

The second switch may be turned on by a same control signal that is supplied to the first switch coupled to the first data line.

The control signal supplied to the first switch coupled to the first data line may overlap with a scan signal during a partial period.

A control signal supplied to a first switch coupled to the second set of data lines may completely overlap with the scan signal.

The second set of data lines may have only one data line.

The device may further include pixels, and pixels positioned on a j-th (j is a natural number) horizontal line may each include an organic light emitting diode, a first transistor controlling an amount of current supplied to the organic light emitting diode, a second transistor coupled between a first electrode of the first transistor and a data line, the second transistor being turned on when a scan signal is supplied to a j-th scan line, a third transistor coupled between a second electrode and a gate electrode of the first transistor, the third transistor being turned on when the scan signal is supplied to the j-th scan line, a storage capacitor coupled between the gate electrode of the first transistor and a first power source, and a sixth transistor coupled between the gate electrode of the first transistor and a second initialization power source, the sixth transistor being turned on when a scan signal is supplied to a (j−1)-th scan line.

The second initialization power source may be set to a voltage lower than that of the data signals.

The second initialization power source may be set to a voltage identical to that of the first initialization power source.

Each pixel may further include a boosting capacitor coupled between the j-th scan line and the gate electrode of the first transistor.

The device may further include emission control lines formed for each horizontal line, and the scan driver may supply an emission control signal to a j-th emission control line so that the emission control signal overlaps with the scan signal supplied to the (j−1)-th and j-th scan lines.

Each pixel may further include a fourth transistor coupled between the first electrode of the first transistor and the first power source, the fourth transistor being turned off when the emission control signal is supplied to the j-th emission control line and otherwise turned on, and a fifth transistor coupled between the second electrode of the first transistor and the organic light emitting diode, the fifth transistor being turned off when the emission control signal is supplied to the j-th emission control line and otherwise turned on.

Embodiments are also directed to a driving method of an organic light emitting display device, the method including supplying a scan signal during a horizontal period, progressively supplying data signals to output lines during the horizontal period, and supplying the plurality of data signals to a plurality of data lines, wherein, during a first period in which a first data signal is supplied to a specific data line among the plurality of data lines, an initialization power source may be supplied to other data lines except the specific data line.

The initialization power source may be set to a voltage lower than that of the data signals.

The initialization power source may be supplied only during the first period.

The period when the first data signal is supplied to the specific data line may be identical to or longer than that when the data signal is supplied to each of the other data lines.

The scan signal may be supplied after the first data signal is supplied to the specific data line.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
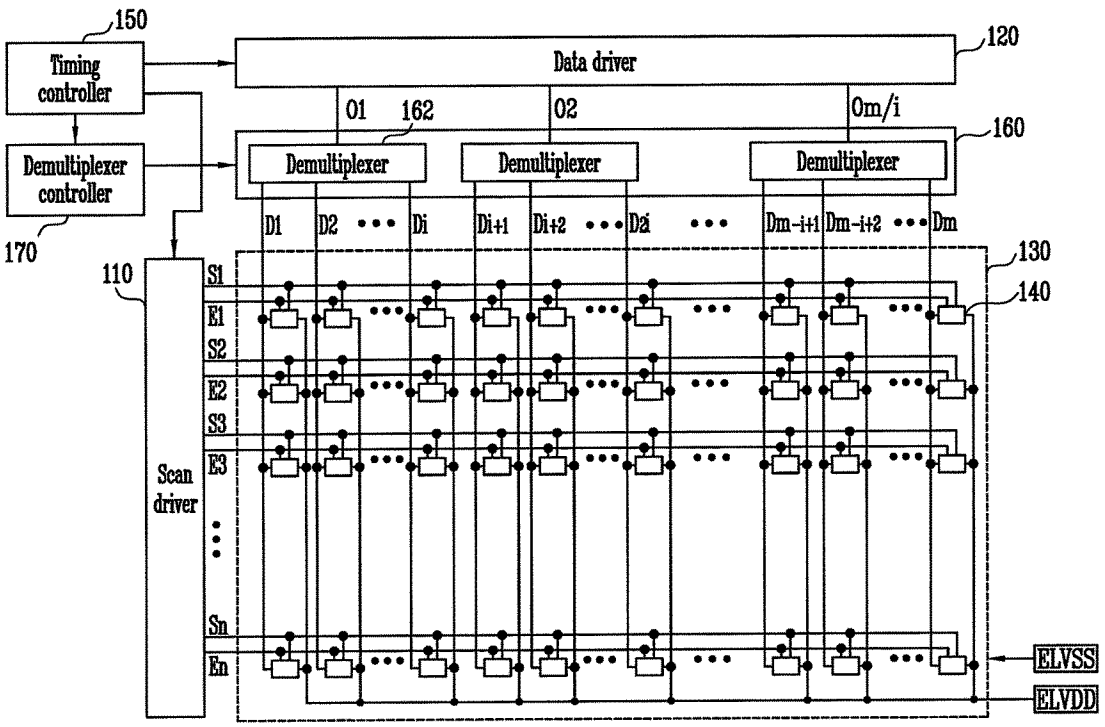
FIG. 1 is a block diagram illustrating an organic light emitting display device according to an embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will frilly convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

FIG. 1 is a block diagram illustrating an organic light emitting display device according to an embodiment.

Referring to FIG. 1, the organic light emitting display device according to this embodiment includes a scan driver 110, a data driver 120, a pixel unit 130, a timing controller 150, a demultiplexer unit 160, and a demultiplexer controller 170.

The pixel unit 130 has pixels 140 positioned at intersection portions of scan lines S1 to Sn and data lines D1 to Dm. Each pixel 140 receives a first power source ELVDD and a second power source ELVSS, supplied from the outside of the pixel unit 130. The pixels 140 receive a data signal while being selected for each horizontal line, corresponding to a scan signal supplied to the scan lines S1 to Sn. Each pixel 140 receiving the data signal generates light with a predetermined luminance while controlling the amount of current flowing from the first power source ELVDD to the second power source ELVSS via an organic light emitting diode (not shown).

The scan driver 110 generates a scan signal under the control of the timing controller 150, and supplies the generated scan signal to the scan lines S1 to Sn. For example, the scan driver 110 may progressively supply a scan signal to the scan lines S1 to Sn. The scan driver 110 generates an emission control signal under the control of the timing controller 150, and progressively supplies the generated emission control signal to emission control lines E1 to En. Here, the emission control signal supplied to a j-th (j is a natural number) emission control line Ej overlaps with the scan signal supplied to a (j−1)-th scan line Sj-1 and a j-th scan line Sj.

The data driver 120 progressively supplies a plurality of data signals to output lines O1 to Om/i (m and i may each be a natural number of 2 or more) of the data driver 120. For example, the data driver 120 may progressively supply i data signals to output lines O1 to Om/i of the data driver 120 for each horizontal period. Here, data driver 120 supplies the i data signals to overlap with the scan signal.

The demultiplexer unit 160 includes a plurality of demultiplexers 162 coupled to the respective output lines O1 to Om/i of the data driver 120. Each demultiplexer 162 is coupled to i data lines D. The demultiplexer 162 provides, to the i data lines D, i data signals supplied from the output line O of the data driver 120 for each horizontal period.

The demultiplexer controller 170 may progressively supply i control signals to each demultiplexer 162. In an example embodiment, the demultiplexer controller 170 supplies the i control signals to each demultiplexer 162 so that the data signal is time-divisionally supplied in the demultiplexer 162. Meanwhile, although the demultiplexer controller 170 has been illustrated as a separate driver in FIG. 1, embodiments are not limited thereto. For example, the timing controller 150 may progressively supply the i control signals to the demultiplexer unit 160.

The timing controller 150 controls the scan driver 110, a data driver 120, and the demultiplexer controller 170, corresponding to synchronization signals supplied from the outside thereof.

Figure 2:
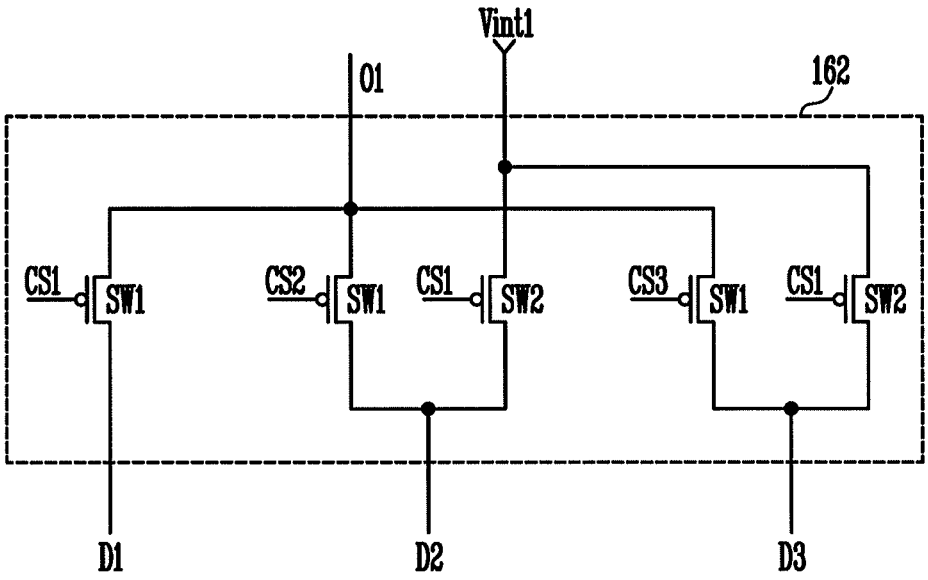
FIG. 2 is a circuit diagram illustrating a demultiplexer according to an embodiment.

FIG. 2 is a circuit diagram illustrating a demultiplexer according to an embodiment. For convenience of illustration, a demultiplexer 162 coupled to a first output line O1 of the data driver 120 is shown in FIG. 2. The demultiplexer 162 is shown as being coupled to three data lines for convenience of explanation.

Referring to FIG. 2, the demultiplexer 162 includes first switches SW1 respectively coupled between the output line O1 of the data driver 120 and a first set of data lines D1 to D3, and second switches SW2 respectively coupled between a first initialization power source Vint1 and a second set of data lines, e.g., data lines D2 and D3.

The first switches SW1 are respectively coupled between the output line O1 of the data driver 120 and each data line D1 to D3. The first switch SW1 is turned on, corresponding to any one of a first control signal CS1, a second control signal CS2, and a third control signal Cs3. Here, the first, second and third control signals CS1, CS2, and CS3 are progressively supplied so as not to overlap with one another for each horizontal period.

The second switches SW2 are respectively coupled between the first initialization power source Vint1 and some data lines D2 and D3, e.g., the other data lines D2 and D3 except the data line D1 receiving a first data signal. The second switch SW2 is turned on when the same control signal as that supplied to the first switch SW1 (which is coupled to the data line D1 receiving the first data signal, i.e., the first control signal) is supplied to the second switch SW2. Meanwhile, the first initialization power source Vint1 is used to initialize the voltage of a previous data signal stored in some data lines D2 and D3. To this end, the first initialization power source Vint1 is set to a voltage lower than that of the data signal.

Figure 3:
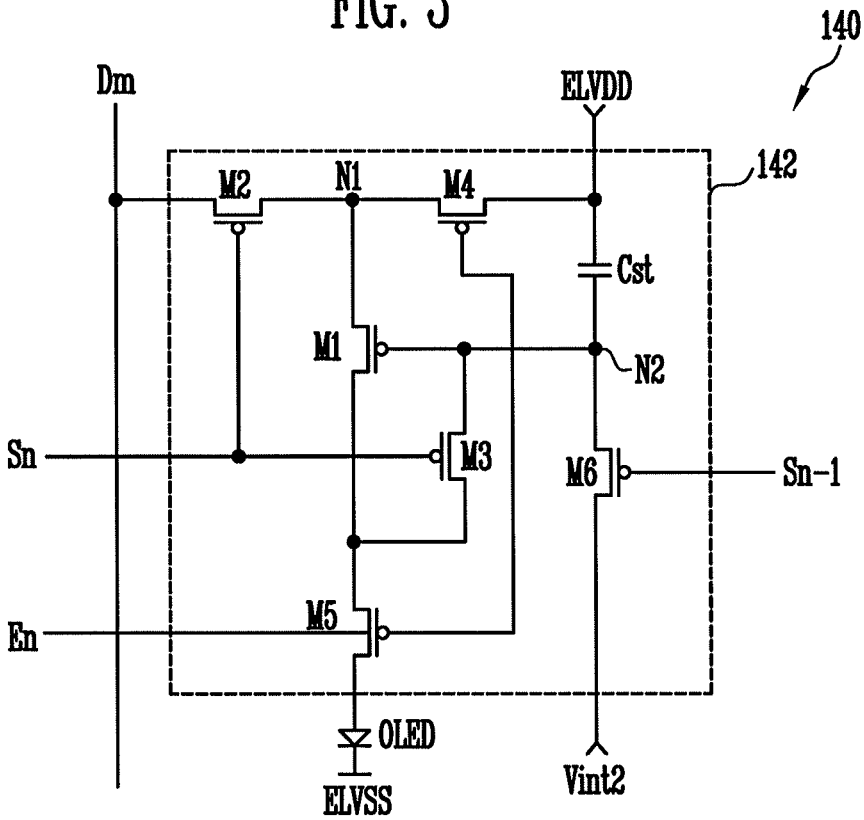
FIG. 3 is a circuit diagram illustrating a pixel according to an embodiment.

FIG. 3 is a circuit diagram illustrating a pixel according to an embodiment. A pixel coupled to an n-th scan line Sn and an m-th data line Dm will be shown in FIG. 3.

Referring to FIG. 3, the pixel 140 according to this embodiment includes an organic light emitting diode OLED, and a pixel unit 142 controlling the amount of current supplied to the organic light emitting diode OLED.

An anode electrode of the organic light emitting diode OLED is coupled to the pixel circuit 142, and a cathode electrode of the organic light emitting diode OLED is coupled to a second power source ELVSS. The organic light emitting diode OLED generates light with a predetermined luminance, corresponding to the amount of current supplied from the pixel circuit 142.

The pixel circuit 142 stores a voltage corresponding to a data signal and the threshold voltage of a driving transistor M1, and controls the amount of current supplied to the organic light emitting diode OLED, corresponding to the stored voltage. In the present embodiment, the pixel circuit 142 may be a suitable circuit that compensates for the threshold voltage of the driving transistor M1. For example, the pixel circuit 142 may include first to sixth transistors M1 to M6 and a storage capacitor Cst.

A first electrode of the first transistor (driving transistor) M1 is coupled to a first node N1, and a second electrode of the first transistor M1 is coupled to a first electrode of the fifth transistor M5. A gate electrode of the first transistor M1 is coupled to a second node N2. The first transistor M1 controls the amount of the current supplied to the organic light emitting diode OLED, corresponding to the voltage stored in the storage capacitor Cst.

A first electrode of the second transistor M2 is coupled to the data line Dm, and a second electrode of the second transistor M2 is coupled to the first node N1. A gate electrode of the second transistor M2 is coupled to the n-th scan line Sn. When a scan signal is supplied to the n-th scan line Sn, the second transistor M2 is turned on to supply a data signal from the data line Dm to the first node N1.

A first electrode of the third transistor M3 is coupled to the second electrode of the first transistor M1, and a second electrode of the third transistor M3 is coupled to the second node N2. A gate electrode of the third transistor M3 is coupled to the n-th scan line Sn. When the scan signal is supplied to the n-th scan line Sn, the third transistor M3 is turned on to allow the first transistor M1 to be diode-coupled.

A first electrode of the fourth transistor M4 is coupled to a first power source ELVDD, and a second electrode of the fourth transistor M4 is coupled to the first node N1. A gate electrode of the fourth transistor M4 is coupled to an emission control line En. When an emission control signal is supplied to the emission control line En, the fourth transistor M4 is turned off, and otherwise, the fourth transistor M4 is turned on.

The first electrode of the fifth transistor M5 is coupled to the second electrode of the first transistor M1, and a second electrode of the fifth transistor M5 is coupled to the anode electrode of the organic light emitting diode OLED. A gate electrode of the fifth transistor M5 is coupled to the emission control line En. When the emission control signal is supplied to the emission control line En, the fifth transistor M5 is turned off, and otherwise, the fifth transistor M5 is turned on.

A first electrode of the sixth transistor M6 is coupled to the second node N2, and a second electrode of the sixth transistor M6 is coupled to a second initialization power source Vint2. A gate electrode of the sixth transistor M6 is coupled to an (n−1)-th scan line Sn-1. When the scan signal is supplied to the (n−1)-th scan line Sn-1, the sixth transistor M6 is turned on to supply the voltage of the second initialization power source Vint2 to the second node N2. Here, the voltage of the second initialization power source Vint2 may be set to a voltage lower than that of the data signal, e.g., the same voltage as that of the first initialization power source Vint1.

The storage capacitor Cst is coupled between the first power source ELVDD and the second node N2. The storage capacitor Cst stores a voltage corresponding to the data signal and the threshold voltage of the first transistor M1.

Figure 4:
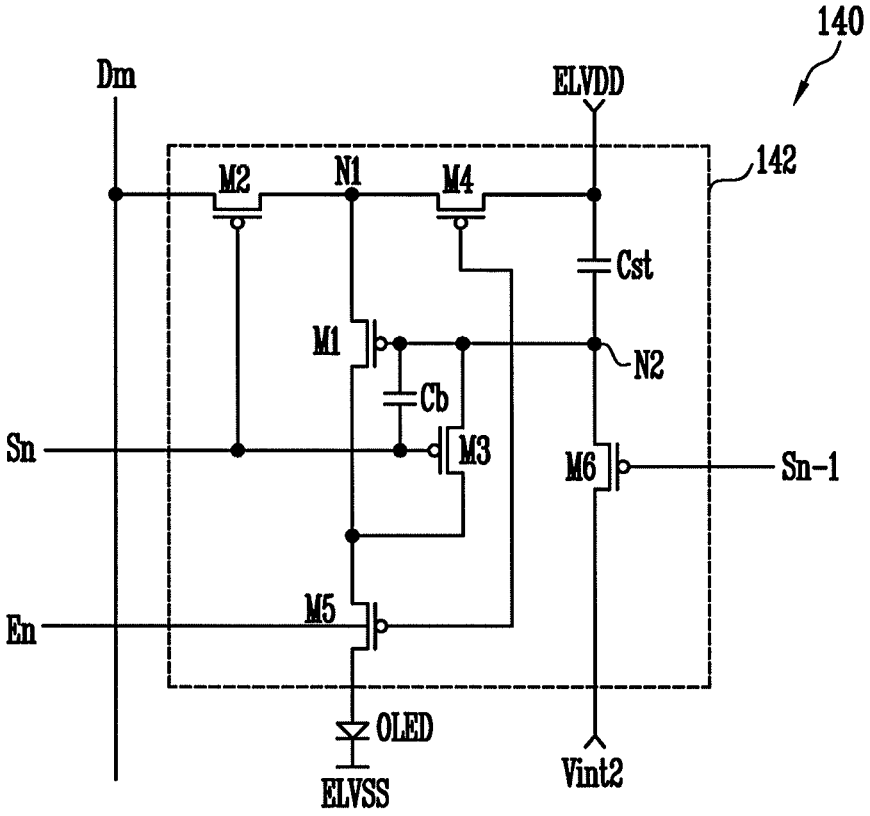
FIG. 4 is a circuit diagram illustrating a pixel according to another embodiment.

In an implementation, as shown in FIG. 4, the pixel circuit 142 may further include a boosting capacitor Cb coupled between the n-th scan line Sn and the second node N2. The boosting capacitor Cb controls the voltage at the second node N2, corresponding to the scan signal supplied to the n-th scan line Sn.

Figure 5:
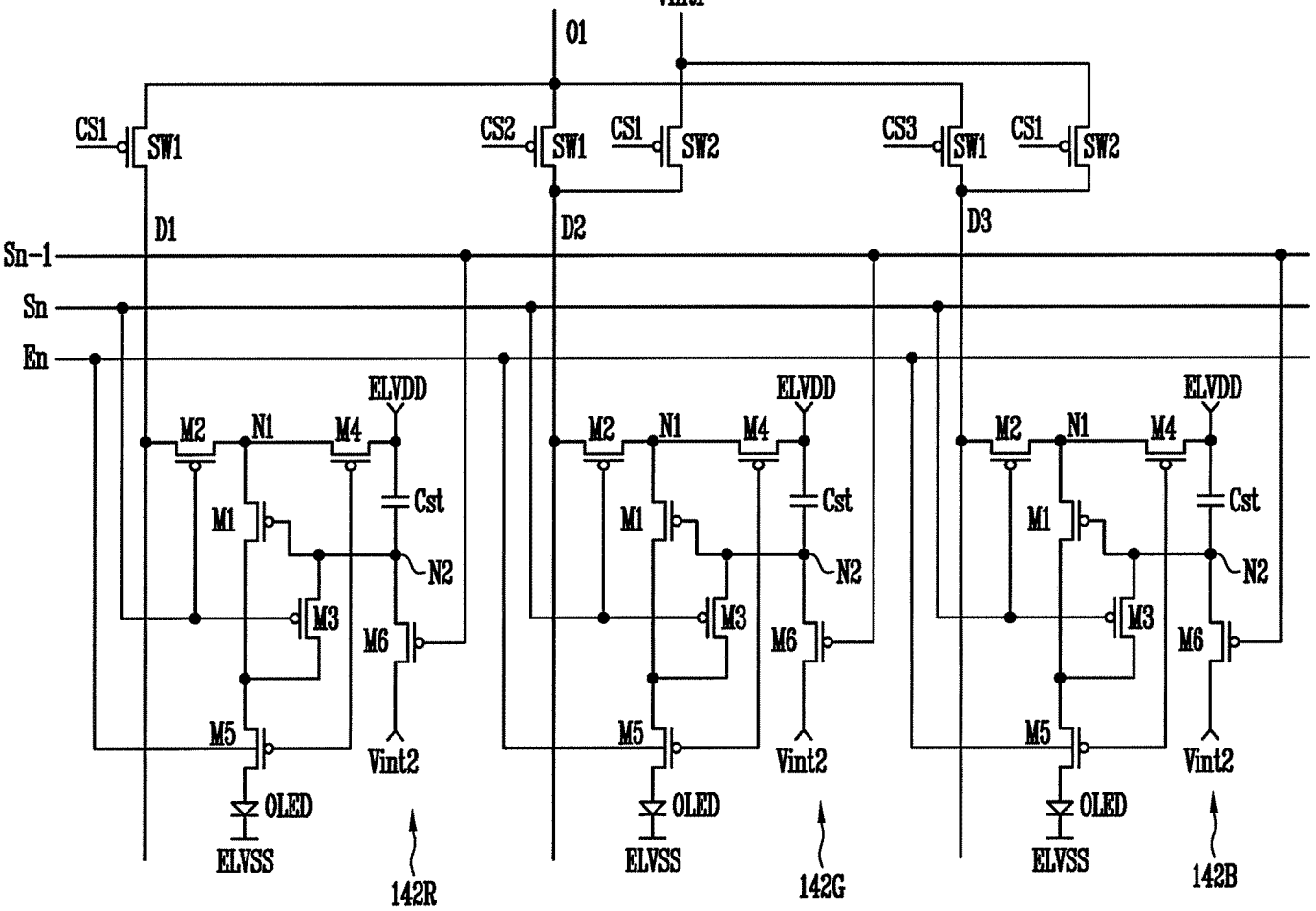
FIG. 5 is a circuit diagram illustrating an embodiment of the coupling structure between a demultiplexer and a pixel.
Figure 6:
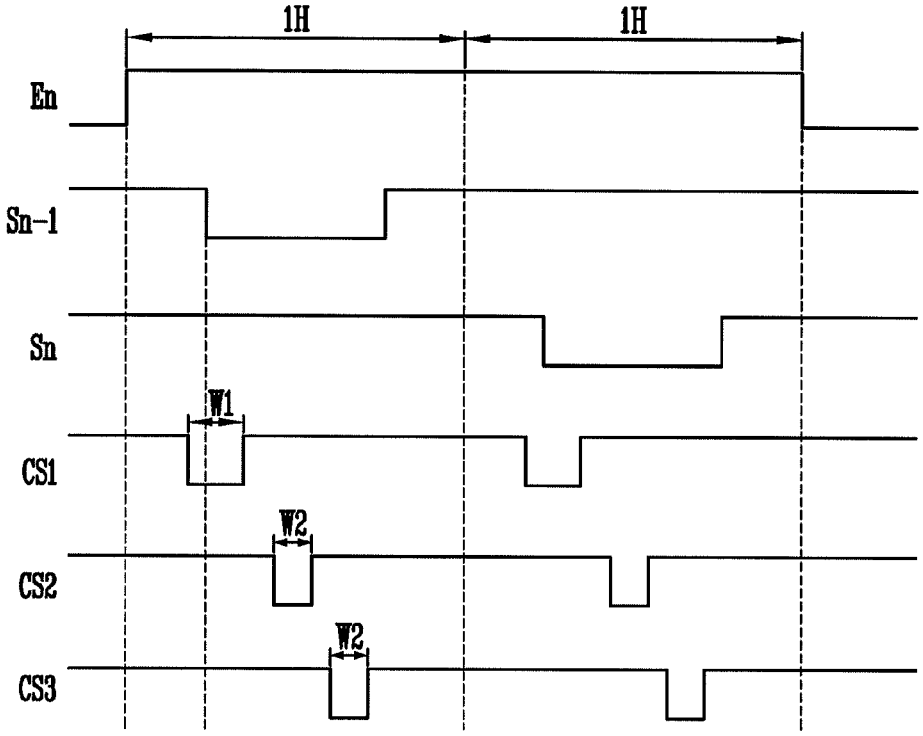
FIG. 6 is a waveform diagram illustrating a driving method of the demultiplexer and the pixel, shown in FIG. 5.

FIG. 5 is a circuit diagram illustrating an embodiment of the coupling structure between a demultiplexer and a pixel. For convenience of illustration, it is assumed that red (R), green (G), and blue (B) pixels are coupled to the demultiplexer in FIG. 5. FIG. 6 is a waveform diagram illustrating a driving method of the demultiplexer and the pixel, shown in FIG. 5.

Referring to FIGS. 5 and 6, an emission control signal is first supplied to the emission control line En. If the emission control signal is supplied to the emission control line En, the fourth and fifth transistors M4 and M5 included in each of the pixels 142R, 142G, and 142B are turned off. If the fourth transistor M4 is turned off, the first power source ELVDD and the first node N1 are electrically cut off. If the fifth transistor M5 is turned off, the organic light emitting diode OLED and the first transistor M1 are electrically cut off. Thus, the pixels 142R, 142G, and 142B are set to be in a non-emission state during the period in which the emission control signal is supplied to the emission control line En.

Subsequently, a scan signal is supplied to the (n−1)-th scan line Sn-1. If the scan signal is supplied to the (n−1)-th scan line Sn-1, the sixth transistor M6 included in each of the pixels 142R, 142G, and 142B is turned on. If the sixth transistor M6 is turned on, the voltage of the second initialization power source Vint2 is supplied to the second node N2. That is, the second node N2 of each of the pixels 142R, 142G and 142B positioned on an n-th horizontal line is initialized to the voltage of the second initialization power source Vint2 during the period in which the scan signal is supplied to the (n−1)-th scan line Sn-1.

Subsequently, the first control signal CS1 is supplied during a next horizontal period so that the first switch SW1 coupled to the first data line D1 is turned on. If the first switch SW1 is turned on, the output line O1 of the data driver 120 and the first data line D1 are electrically coupled to each other. In this case, a data signal corresponding to a current horizontal period is supplied to the first data line D1.

If the first control signal CS1 is supplied, the second switches SW2 coupled to the second and third data lines D2 and D3 are turned on. If the second switch SW2 is turned on, the voltage of the first initialization power source Vint1 is supplied to the second and third data lines D2 and D3. That is, when the first control signal CS1 is supplied, the second and third data lines D2 and D3 are initialized to the voltage of the first initialization power source Vint1, regardless of the data signal supplied during a previous horizontal period.

That is, in the present embodiment, when the scan signal is supplied to the (n−1)-th scan line Sn-1, the second node N2 of each of the pixels 142R, 142G, and 142B is initialized to the voltage of the second initialization power source Vint2. Before the scan signal is supplied to the (n−1)-th scan line Sn-1, the data signal corresponding to the current horizontal period is supplied to the first data line D1, and the voltage of the first initialization power source Vint1 is supplied to the second and third data lines D2 and D3. To this end, the first control signal CS1 may be set to have a width identical to or wider than that of each of the second and third control signals CS2 and CS3 (W1≥W2).

After the first control signal CS1 is supplied, the scan signal is supplied to the n-th scan line Sn so as to overlap with the first control signal CS1. Thus, the second and third transistors M2 and M3 included in each of the pixels 142R, 142G, and 142B are turned on. If the second and third transistors M2 and M3 included in the pixel 142R are turned on, the data signal supplied to the first data line D1 is supplied to the second node N2 via the diode-coupled first transistor M1. In this case, the storage capacitor Cst included in the pixel 142R charges the data signal and a voltage corresponding to the threshold voltage of the first transistor M1. Meanwhile, since the second and third data lines D2 and D3 are initialized to the voltage of the first initialization power source Vint1, the diode-coupled first transistor M1 included in each of the pixels 142G and 142B is set to be in a turn-off state.

After a voltage corresponding to the data signal is charged in the pixel 142R, the second control signal CS2 is supplied to the pixel 142R so that the first switch SW1 coupled to the second data line D2 is turned on. If the first switch SW1 is turned on, the data signal from the output line O1 of the data driver 120 is supplied to the second data line D2. If the data signal is supplied to the second data line D2, the diode-coupled first transistor M1 included in the pixel 142G is turned on. Then, the storage capacitor Cst included in the pixel 142G charges the data signal and the voltage corresponding to the threshold voltage of the first transistor M1.

After a voltage corresponding to the data signal is charged in the pixel 142G, the third control signal CS3 is supplied to the pixel 142G so that the first switch SW1 coupled to the third data line D3 is turned on. If the first switch SW1 is turned on, the data signal from the output line O1 of the data driver 120 is supplied to the third data line D3. If the data signal is supplied to the third data line D3, the diode-coupled first transistor M1 included in the pixel 142B is turned on. Then, the storage capacitor Cst included in the pixel 142B charges the data signal and the voltage corresponding to the threshold voltage of the first transistor M1.

Subsequently, the supply of the emission control signal to the emission control line En is stopped so that the fourth and fifth transistors M4 and M5 included in each of the pixels 142R, 142G, and 142B are turned on. Then, the first transistor M1 included in each of the pixels 142R, 142G, and 142E generates light with a predetermined luminance while controlling the amount of current supplied to the organic light emitting diode OLED, corresponding to the voltage charged in the storage capacitor Cst.

As described above, in the present embodiment, the scan signal supplied to the scan lines S1 to Sn can overlap with the control signals CS1 to CS3 for controlling the demultiplexer 162. In this case, the data supply time may be maximally secured, and accordingly, it may be possible to improve image quality and implement high resolution. In the present embodiment, the data signal supplied from the output line O1 of the data driver 120 is not stored in a separate capacitor (e.g., a parasitic capacitor) and then supplied, but directly supplied to the pixel 142. If the data signal from the output line O1 of the data driver 120 is directly supplied to the pixel 142 as described above, it may be possible to minimize the time required to charge the data signal.

Figure 7:
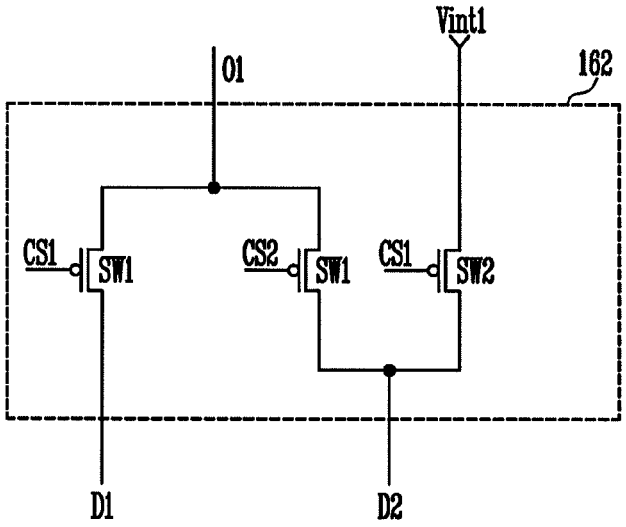
FIG. 7 is a circuit diagram illustrating a demultiplexer according to another embodiment.

FIG. 7 is a circuit diagram illustrating a demultiplexer according to another embodiment. FIG. 7 illustrates a case where the demultiplexer 162 is coupled to two data lines.

Referring to FIG. 7, the demultiplexer 162 according to this embodiment includes first switches SW1 respectively coupled between the output line O1 of the data driver 120 and the data lines D1 and D2, and a second switch SW2 coupled between the first initialization power source Vint1 and the second data line D2.

The first switches SW1 are respectively coupled between the output line O1 of the data driver 120 and the data lines D1 and D2. The first switches SW1 are progressively turned on, corresponding to the control signals CS1 and CS2. Here, the first switch SW1 coupled to the first data line D1 is turned on, corresponding to the first control signal CS1, and the first switch SW1 coupled to the second data line D2 is turned on, corresponding to the second control signal CS2 supplied after the first control signal is supplied.

The second switch SW2 is coupled to the demultiplexer 162 so as to be coupled the first initialization power source Vint1 and the other data line D2 except the data line D1 to which the data signal is initially supplied. When the first control signal CS1 is supplied, the second switch SW2 is turned on to supply the voltage of the first initialization power source Vint1 to the second data line D2. The subsequent operation procedure is identical to that in FIG. 5, and therefore, its detailed description will be omitted.

By way of summation and review, a general organic light emitting display device may include a data driver supply a data signal to data lines, a scan driver progressively supplying a scan signal to scan lines, and a pixel unit having a plurality of pixels coupled to the scan lines and the data lines.

When a scan signal is supplied from the scan line, the pixel receives a data signal supplied from the data line, and emits light with a predetermined luminance while supplying current corresponding to the data signal to the organic light emitting diode, using a driving transistor. The threshold voltage of the driving transistor may be compensated by allowing the driving transistor to be diode-coupled in order to display a uniform image.

Meanwhile, a structure in which a demultiplexer is added to be coupled to each output line of the data driver may be considered in order to reduce manufacturing cost. The demultiplexer time-divisionally supplies, to a plurality of data lines, a plurality of data signals supplied to the respective output lines of the data driver. However, in a case where the demultiplexer is added, one horizontal period may be divided into a data supply period (or a demultiplexer control signal supply period) and a scan signal supply period due to characteristics of the diode-coupled driving transistor.

More specifically, the gate electrode of a driving transistor in each pixel positioned on the current horizontal line may first be initialized to a predetermined voltage by a data signal supplied to the previous horizontal line. Subsequently, the demultiplexer progressively supplies a plurality of data signals to the plurality of data lines during the data supply period. A scan signal is supplied to the scan line during the scan signal supply period after the data supply period so that the data signal supplied to the data line is input to the pixels positioned on the horizontal lines. In a general organic light emitting display device, when the scan signal and the data signal overlap with each other, a desired data signal may not be supplied to the pixel. In other words, the data signal previously charged in the previous period is supplied to the pixel during the period in which the scan signal is supplied.

Meanwhile, if the horizontal period is divided into the data supply period and the scan signal supply period, the period in which the data signal is supplied to each pixel is decreased. Accordingly, the threshold voltage of the driving transistor may not be compensated, and therefore, the display quality may be deteriorated. Particularly, in a case where the horizontal period is divided in the general organic light emitting display device, the period in which the data signal is supplied may decrease, and therefore, it may be difficult to implement a high-resolution panel.

As described above, embodiments may provide an organic light emitting display device and a driving method thereof that can improve image quality. In the organic light emitting display device and the driving method thereof according to embodiments, the voltage of an initialization power source is supplied to other data lines coupled to a demultiplexer during the period in which a first data signal is supplied to a specific data line in the demultiplexer. That is, the other data lines are initialized from the voltage of a previous data signal to the voltage of the initialization power source during the period in which the first data signal is supplied to the specific data line.

If the other data lines are initialized to the voltage of the initialization power source, data signals and a scan signal may be supplied while overlapping with each other during a horizontal period, and accordingly, it may be possible to enhance display quality. According to embodiments, the data signals and the scan signal may overlap with each other, thereby enabling high resolution.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting display device, comprising:

a scan driver progressively supplying scan signals to scan lines;

a data driver supplying data signals to output lines of the data driver, the data signals including first and second data signals being sequentially supplied to a corresponding output line during a horizontal period; and demultiplexers respectively coupled to the output lines of the data driver, and supplying the data signals to data lines connected to pixels, each demultiplexer including:

a first switch coupled between the corresponding output line and a first data line, the first switch to supply the first data signal from the corresponding output line to the first data line by a first control signal during the horizontal period;

a second switch coupled between the corresponding output line and a second data line, the second switch to supply the second data signal from the corresponding output line to the second data line by a second control signal during the horizontal period; and a third switch coupled between a first initialization power source and the second data line, the third switch to supply the first initialization power source to the second data line by the first control signal during the horizontal period, wherein:

the first control signal being commonly supplied to the first switch and the third switch is before the second control signal being supplied to the second switch during the horizontal period, and the first control signal has a width longer than that of the second control signal.

2. The device as claimed in claim 1, wherein the first initialization power source is set to a voltage lower than those of the data signals.

3. The device as claimed in claim 1, wherein the data signals further include a third data signal being supplied to the corresponding output line during the horizontal period, wherein each demultiplexer further includes:

a fourth switch coupled between the corresponding output line and a third data line, the fourth switch to supply the third data signal from the corresponding output line to the third data line by a third control signal during the horizontal period; and a fifth switch coupled between the first initialization power source and the third data line, the fifth switch to supply the first initialization power source to the third data line by the first control signal during the horizontal period, wherein the first control signal is commonly supplied to the first switch, the third switch, and the fifth switch.

4. The device as claimed in claim 1, wherein the first and second data switches are progressively turned on by the first and second control signals.

5. The device as claimed in claim 4, wherein the first control signal supplied to the first switch coupled to the first data line partially overlaps a scan signal during the horizontal period.

6. The device as claimed in claim 5, wherein the second control signal supplied to the second switch coupled to the second data line completely overlaps the scan signal during the horizontal period.

7. The device as claimed in claim 1, wherein the pixels include pixels positioned on a j-th horizontal line, wherein j is a natural number, each of the pixels on the j-th horizontal line include:

an organic light emitting diode;

a first transistor controlling an amount of current supplied to the organic light emitting diode;

a second transistor coupled between a first electrode of the first transistor and the corresponding data line, the second transistor being turned on when a j-th scan signal is supplied to a j-th scan line;

a third transistor coupled between a second electrode and a gate electrode of the first transistor, the third transistor being turned on when the j-th scan signal is supplied to the j-th scan line;

a storage capacitor coupled between the gate electrode of the first transistor and a first power source; and a sixth transistor coupled between the gate electrode of the first transistor and a second initialization power source, the sixth transistor being turned on when a (j−1)-th scan signal is supplied to a (j−1)-th scan line.

8. The device as claimed in claim 7, wherein the second initialization power source is set to a voltage lower than those of the data signals.

9. The device as claimed in claim 8, wherein the second initialization power source is set to a voltage identical to that of the first initialization power source.

10. The device as claimed in claim 7, wherein each pixel further includes a boosting capacitor coupled between the j-th scan line and the gate electrode of the first transistor.

11. The device as claimed in claim 7, further comprising emission control lines formed along horizontal lines, wherein the scan driver supplies an emission control signal to a j-th emission control line so that the emission control signal overlaps the (j−1)-th and j-th scan signals supplied to the (j−1)-th and j-th scan lines, respectively.

12. The device as claimed in claim 11, wherein each pixel further includes:

a fourth transistor coupled between the first electrode of the first transistor and the first power source, the fourth transistor being turned off when the emission control signal is supplied to the j-th emission control line and otherwise turned on; and a fifth transistor coupled between the second electrode of the first transistor and the organic light emitting diode, the fifth transistor being turned off when the emission control signal is supplied to the j-th emission control line and otherwise turned on.

13. The device as claimed in claim 1, wherein a j-th scan signal, the first control signal, and the second control signal are supplied during a horizontal period, the j-th scan signal being supplied to pixels on a j-th horizontal line, wherein j is a natural number, and wherein a start point of the first control signal commonly supplied to the first data switch and the third switch is before a start point of the j-th scan signal, and an end point of the first control signal is after the start point of the j-th scan signal.

14. The device as claimed in claim 1, wherein:

a start point of the first control signal is before a start signal point of a scan signal during the horizontal period, and an end point of the first control signal is after the start signal of the scan signal during the horizontal period.

15. A driving method of an organic light emitting display device, the method comprising:

supplying a j-th scan signal to a j-th scan line connected to pixels on a j-th horizontal line during a horizontal period, wherein j is a natural number,;

progressively supplying first and second data signals to an output line during the horizontal period; and respectively supplying the first and second data signals from the output line to first and second data lines connected to the pixels during the horizontal period, wherein during a first period of the horizontal period, in which the first data signal is supplied to the first data line, a first control signal is supplied to a first switch for supplying the first data signal to the first data line and a third switch for supplying an initialization power source to the second data line, and during a second period of the horizontal period, in which the second data signal is supplied to the second data line, a second control signal is supplied to a second switch for supplying the second data signal to the second data line, and wherein:

the first control signal being commonly supplied to the first switch and the third switch is before the second control signal being supplied to the second switch during the horizontal period, and the first control signal has a width longer than that of the second control signal.

16. The method as claimed in claim 15, wherein the initialization power source is set to a voltage lower than those of the data signals.

17. The method as claimed in claim 15, wherein the initialization power source is supplied only during the first period.

18. The method as claimed in claim 15, wherein the first period when the first data signal is supplied to the first data line longer than that when the second data signal is supplied to the second data line.

19. The method as claimed in claim 15, wherein:

the j-th scan signal, the first control signal, and the second control signal are supplied during the horizontal period, and the j-th scan signal is supplied after the first control signal is supplied to the first switch during the horizontal period.

* * * * *